US005260848A

United States Patent [19]

Childers

[11] Patent Number: 5,260,848

[45] Date of Patent: * Nov. 9, 1993

[54] FOLDBACK SWITCHING MATERIAL AND DEVICES

[75] Inventor: Richard K. Childers, San Mateo County, Calif.

[73] Assignee: Electromer Corporation, Palo Alto, Calif.

[ * ] Notice: The portion of the term of this patent subsequent to Dec. 11, 2007 has been disclaimed.

[21] Appl. No.: 559,202

[22] Filed: Jul. 27, 1990

[51] Int. Cl.[5] ..... H01C 7/10

[52] U.S. Cl. ..... 361/127; 361/117; 338/21

[58] Field of Search ..... 361/88, 127, 117; 338/20, 21; 428/329

[56] References Cited

U.S. PATENT DOCUMENTS 3,685,026 8/1972 Wakabayashi et al. ..... 338/20
4,097,834 6/1978 Mar et al. ..... 338/21
4,331,948 5/1982 Malinaric et al. ..... 338/21
4,726,991 2/1988 Hyatt et al. ..... 361/127
4,977,357 12/1990 Shrier ..... 338/21
5,068,634 11/1991 Shrier ..... 361/127

*Primary Examiner*—A. D. Pellinen
*Assistant Examiner*—S. Jackson
*Attorney, Agent, or Firm*—Flehr, Hohbach, Test, Albritton & Herbert

[57] ABSTRACT

A material and device for electronic circuitry that provides protection from fast transient over-voltage pulses. Conductive particles are dispersed in an insulating matrix to provide material having foldback switching characteristics. The foldback switching characteristics of the material are determined by the spacing between the conductive particles (which must be at least 1000 Angstroms) as well as by the electrical properties of the insulating matrix.

21 Claims, 4 Drawing Sheets

FOLDBACK SWITCHING MATERIAL AND DEVICES

FIELD OF THE INVENTION

This invention relates to foldback switching devices, their manufacture, testing and use and to articles comprising the devices. More particularly, this invention relates to novel fast foldback switching devices having unexpectedly superior combinations of electrical properties, switching clamping voltage stability and cycle life stability. In particular, this invention relates to devices which are particularly useful for protecting substrates such as electrical circuits especially those containing semiconductor devices against voltage transients.

BACKGROUND OF THE INVENTION

It is well known that electronic circuitry must be protected from transient voltage and current conditions which exceed the capacity of the circuitry. Such electrical transients can damage circuit elements and can cause errors in operation. Switching devices such as gas tubes, vacuum gaps, semiconductors such as Zener or avalanche diodes, amorphous semiconductor diodes such as chalcogenides and the like are well known and have been suggested for use as circuit protection devices. However, many of these switching devices are not satisfactory when used in modern electronic equipment, in some cases because of slow response time, short operating cycle life, too high threshold voltage to trigger operation or inability to handle the energies contained in transient pulses resulting from, for example, lightning discharges.

U.S. Pat. No. 3,685,026 discloses a switching element which has finely divided conductive particles having an average particle size from 0.1 to 10 microns dispersed in resin. U.S. Pat. No. 4,726,991 discloses a matrix formed of a mixture of separate particles of conductive materials and separate particles of semiconductor materials coated with insulating material to provide chains of the particles within the matrix with interparticle separation distances along the chain less than several hundred angstroms, thereby to permit quantum-mechanucal tunneling of electrons between the separate particles in response to high energy electrical transients.

OBJECTS AND SUMMARY OF THE INVENTION

It is therefor an object of this invention to provide an improved foldback switching material which has the ability to respond repetitively to voltage transients carrying substantial energy.

It is a further object of this invention to provide an improved foldback switching material which can be selectively formulated to selectively clamp voltage transients at voltages ranging from 50 to 5,000 volts.

It is a further object of this invention to provide an improved foldback switching material that can be easily provided in a variety of different geometries thereby to selectively clamp voltage transients at voltages ranging from 50 to 5,000 volts.

We have discovered a class of foldback switching devices having unexpectedly superior combinations of electrical properties such as switching clamping stability, ability to handle long duration high energy pulses such as result from, for example, lightning discharges and cycle switching stability. More specifically devices within this class exhibit low capacitance, high off-state resistance, higher energy handling capability for their size than prior art devices, high reliability and may be manufactured at low cost.

In summary the present invention relates to materials, and devices using said materials, which protect electronic circuits from repetitive transient electrical overstresses.

More particularly, the materials have foldback switching characteristics and can respond to repetitive electrical transients with 100 nanosecond or greater rise times, have low electrical capacitance, have the ability to handle substantial energy, and have electrical resistances in normal operation which can be made to be extremely high.

By foldback switching I mean that such materials at voltages below a clamping voltage exhibit a high resistivity of at least $10^6$ ohm-cm, in many instances at least $10^8$ ohm-cm. The material switches to a low resistance state upon application of a high voltage greater than the threshold voltage but reverts to its high resistance state once the applied voltage decreases to a value less than a second voltage level which is called the clamping voltage. Moreover, these materials can maintain their high resistance characteristic at voltages which are at least 70% of the clamping voltage, for example, 80% of the clamping voltage and in some cases even at least 90% of the clamping voltage. Thus below the clamping voltage these materials can be selected to function as insulating materials. In its low resistance state, the resistivity of the material of the invention is quite low, for example, less than 1000 ohm-cm, preferably less than 100 ohm-cm and may be less than 10 ohm-cm, for example, less than 1 ohm-cm. Thus devices of the invention employing these materials exhibit resistances of at least $10^6$ ohms, and in many instances at least $10^8$ ohms, preferably at least $10^9$ ohms, for example, $10^{10}$ ohms at voltages below the clamping voltage (for example at 100 volts potential difference). In the low resistance state devices of the invention exhibit resistances of less than 1000 ohms, preferably less than 100 ohms and may be less than 10 ohms, for example, less than 5 ohms.

In a first aspect, the invention provides a foldback switching material comprising:

a) an insulating matrix; and b) conductive particles, which have particle sizes in the range 10 microns to two hundred microns and are spaced at least 1000 Angstroms apart, dispersed in the matrix;

the material having a very high electrical resistance at an applied voltage below a clamping voltage and a very low electrical resistance at an applied voltage above the clamping voltage.

In a second aspect, the invention provides a foldback switching device comprising a foldback switching material positioned between electrodes, the material comprising:

a) an insulating matrix; and b) conductive particles, which have particle sizes in the range 10 microns to two hundred microns and are spaced at least 1000 Angstroms apart, dispersed in the matrix;

which material has a very high electrical resistance at applied voltages below a clamping voltage and a very low electrical resistance at applied voltages above the clamping voltage.

In a further aspect, the invention provides an electrical circuit, which is subject to voltage transients, comprising:

(A) an electrical component which is damaged by application of such a transient thereunto;

(B) a current carrying line;

(C) an earth and (D) a foldback switching device, connected between the current carrying line and earth, which comprises a foldback switching material positioned between electrodes, the material comprising:

a) an insulating matrix; and b) conductive particles, which have particle sizes in the range 10 microns to two hundred microns and are spaced at least 1000 Angstroms apart, dispersed in the matrix; and the material having a very high electrical resistance at applied voltages below a clamping voltage and a very low electrical resistance at applied voltages above the clamping voltage.

In a further aspect, the material of the invention includes, in addition to the conductive particles, semi-conductive particles as discussed in detail below. It has been found that the use of a combination of certain conductive and semi-conductive particles can improve the stability, i. e. useful operating life, of the material.

DETAILED DESCRIPTION OF THE INVENTION

Figure 1:
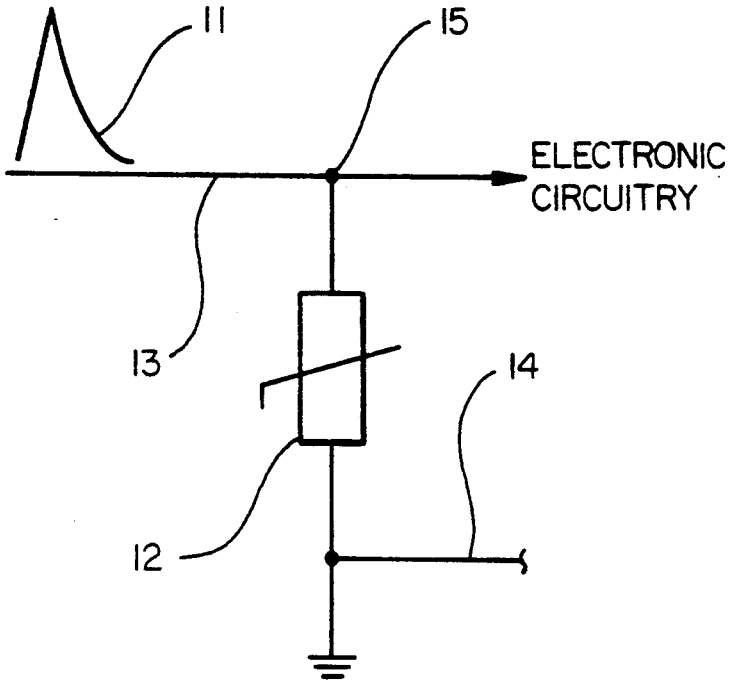
FIG. 1 shows a typical electronic circuit using devices of the present invention.

The use of conductive particles dispersed in a matrix or binder enables the invention to be provided in virtually unlimited sizes, shapes, and geometries depending on the desired application. The materials formulations and device geometries can be tailored to provide a range of clamping voltages ranging from fifty (50) volts to fifteen thousand (15,000) volts. Preferably, the matrix material is an insulator.

The foldback switching materials contemplated by this invention are comprised of conductive particles dispersed in an insulating matrix or binder. The maximum size of the particles is determined by the spacing between the electrodes. The electrode spacing should equal at least 2 particle diameters, for example, at least 3 particle diameters, preferably at least five particle diameters. For example, using electrode spacings of approximately one thousand microns, maximum particle size is approximately two hundred microns. Smaller particle sizes can also be used as discussed with greater particularity below. The spacing between the conductive particles must be sufficient to avoid quantum-mechanical tunneling, which would lead to a in the resistance of the material at applied voltages generally greater than about 65% of the clamping voltage. In general it has been found that an spacing between the conductive particles of at least 1,000 Å (Angstrom units), for example at least 5,000 Å, is sufficient to avoid quantum mechanical tunneling. More preferably, the spacing between the conductive particles is at least 1 micron, for example at least 5 microns. Most preferably, the interparticle spacing is at least 10 microns.

The threshold voltage of devices of the invention has been found to vary to some extent, depending inter alia on the impedance of the transient pulse source and the rise time and other electrical characteristics of the incoming pulse.

As shown in FIG. 1, devices made from the present invention provide protection of associated circuit components and circuitry against incoming transient over-voltage signals. The electrical circuitry 10 in FIG. 1 operate at voltages generally less than a specified value termed V and can be damaged by incoming transient over-voltages of more than two or three times V. In FIG. 1 the transient over-voltage 11 is shown entering the system on electronic line 13. Such transient incoming voltages can result, for example, from lightning and inductive power surges. Upon application of such transient over-voltages the switching device 12 switches from a high-resistance state to a low-resistance state thereby clamping the voltage at point 15 to a safe value and shunting excess electrical current from the incoming line 13 to the system ground 14.

The switching material is comprised of conductive particles that are dispersed in an insulating matrix or binder by using standard mixing techniques. The on-state resistance of the material is low as stated above. The conductive particles are sufficiently far apart that the off-state resistance of the material is determined largely by the resistance of the insulating matrix or binder. The matrix or binder serves two roles electrically: first it provides a media for tailoring separation between conductive particles, thereby controlling the clamping voltage, and second as an insulator it allows the electrical resistance of the homogeneous dispersion to be tailored. During normal operating conditions and within normal operating voltage ranges, with the switching material in the off-state, the resistance of the material can be very high, as described above. For both materials, and devices made therefrom, conduction in response to an over-voltage transient is primarily between closely adjacent conductive particles. Although we do not wish to be limited to any particular theory of operation of this invention it is believed that at or above the clamping voltage of devices containing the material, the applied voltage stress causes dielectric breakdown of the matrix or binder to occur, conduction of the transient pulse from one electrode of the device to the other occuring via the micro-plasma thereby created in the body of the material. It is an unexpected and very surprising benefit of the invention that such dielectric breakdown does not result in catastrophic dielectric breakdown (that is, breakdown leading to the irreversible formation of short circuit paths through the matrix material).

Figure 2:
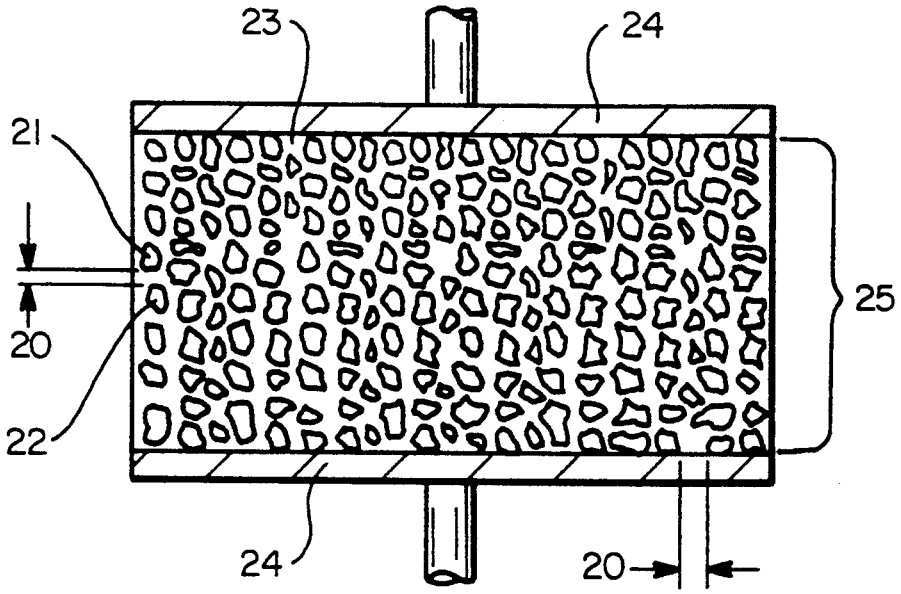
FIG. 2 is a magnified view of a cross-section of the switching material.

FIG. 2 illustrates schematically a two terminal device having a foldback switching material 25 positioned between two electrodes, 24. The clamping voltage for switching from a high resistance state to a low resistance state is determined by the separation distance 20 from particle 21 to particle 22 and the electrical properties of the insulating matrix or binder material 23. In the off-state this potential barrier is relatively high and results in a high electrical resistivity for the switching material. The specific value of the bulk resistivity can be tailored by selection of the composition of the matrix or binder itself and to a smaller extent by adjusting the volume percent loading of the conductive particles in the matrix or binder, the particle size and the shape. For a well blended, homogeneous system, the volume percent loading of a particular size of particles determines the average inter-particle spacing.

In general, the conductive particles used in this invention have particle sizes of from 10 to 200 microns. However, I have found that, in general, better results are obtained with larger particles, for example particles at least 20 microns in size, preferably at least 30 microns in size, more preferably at least 35 microns in size, for example, at least 40 microns in size. Although we do not want to be limited to any particular interpretation, we believe this is because larger conductive particles are better able to withstand the high currents which can flow through the device in its low resistance state. However, even greater stability is observed if semi-conductive particles as well as conductive particles are used in the material of the invention. Generally the amount of semi-conductive particles is less than the amount of conductive particles.

Devices made from the material of the invention have very low capacitances, often less than 100 picofarads, for example, less than 50 picofarads and even less than 20 picofarads, for example less than 10 picofarads. This renders them of particular use in high frequency applications.

Figure 3:
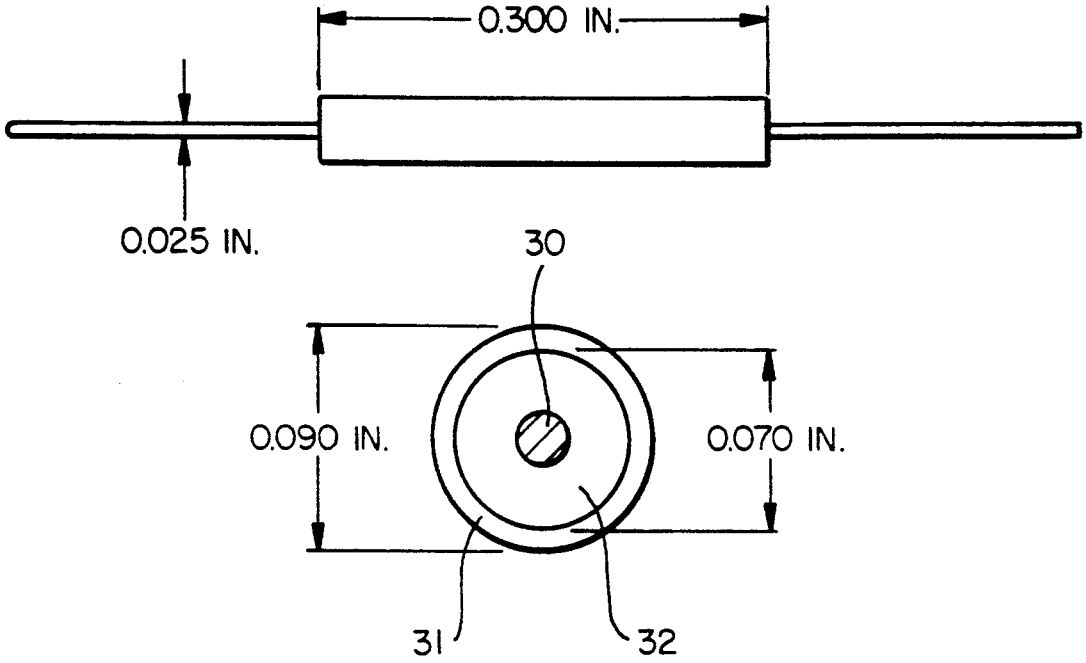
FIG. 3 shows a typical device embodiment using the materials of the invention.

A typical coaxial device embodiment using the materials of the invention is shown in FIG. 3. The particular design in FIG. 3 is tailored to protect a electronic components in printed circuit board applications. This coaxial device of the invention has a central solid (0.025"[0.635 mm]diameter) copper conductor or "pin" as one electrode 30 and an outer tubular member or "ferrule" ( i. d., 0.070"[1.778 mm]; o. d., 0.118"[2.997 mm]; length 0.300"[7.62 mm]) as the other electrode 31, the volume therebetween being filled with a material of this invention 32, to be presently described.

Figure 4:
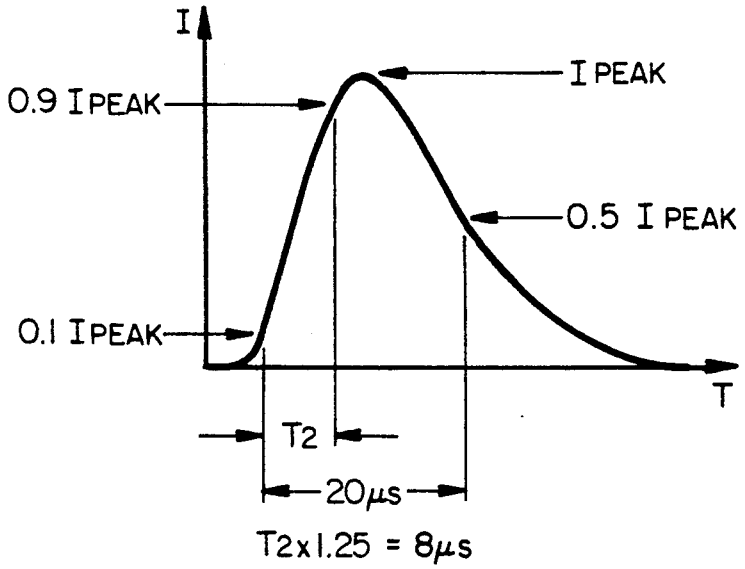
FIG. 4 is a schematic of a waveform which simulates a transient pulse resulting from lightning discharges.
Figure 5:
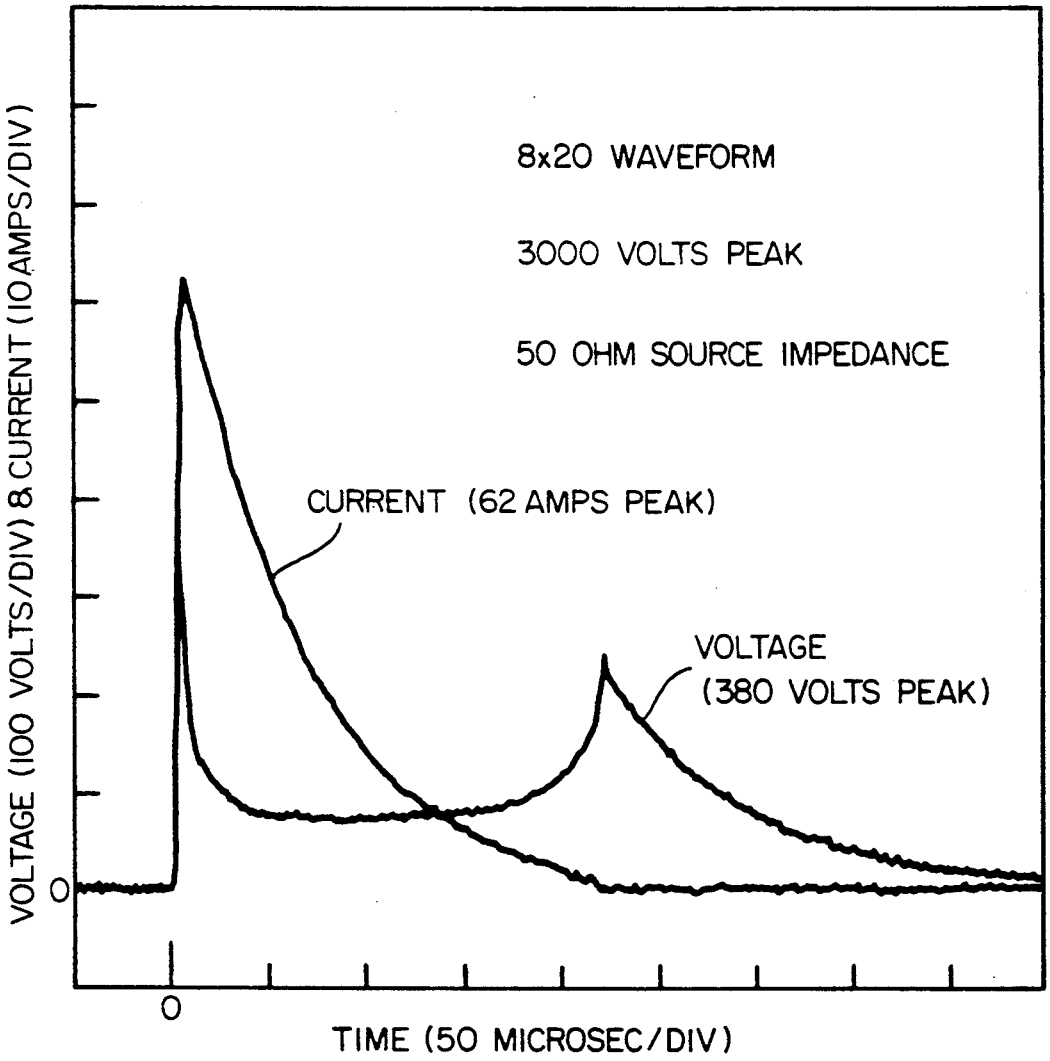
FIG. 5 is a graph of voltage across and current through a device as shown in FIG. 3, subjected to the pulse shown in FIG. 4.

The materials and devices of the invention excel in their ability safely to dissipate higher energy pulses such as result from lightning. A device having the configuration of FIG. 3 and containing the material of the invention described in Example 1 below was tested by applying to it an electrical pulse from a lightning simulator. The incoming pulse used is characterized as an 8/20 microsecond dual exponential waveform, that is to say, the simulator will produce a pulse under short circuit conditions having the characteristics shown in FIG. 4 (as described in ANSI/IEEE 62.41-1980). This type of waveform is also known as a Combination wave (see, for example, UL1449 and IEC 65). FIG. 5 shows the response of the device to this pulse which was applied to the device through a 50 ohm source impedance. The maximum pulse amplitude was 3000 volts. It can be seen that the device of the present invention clamped the voltage during nearly all of the pulse to a value under 100 volts. Even the peak value of very narrow "spike" on the leading edge, which is an indication of the threshold voltage of the device, is under 300 volts. Thus the clamping voltage of a device of the invention is less than its threshold voltage. Of course, the relative values of the threshold voltage and the clamping voltage will depend on the rise time of the leading edge of an incoming pulse. Pulses with slower rise times will result in threshold voltages and clamping voltages that are closer together. Maximum current through the device was 62 amps at the peak. This test shows that materials and devices of the present invention are very well suited to long duration pulses because the voltage on the device was limited to less than 200 volts over the duration of the pulse.

In general it is found that devices of the invention can withstand at least 15 pulse waveforms having a sufficient pulse amplitude to cause the device to switch to its low resistance state and still continue to exhibit a very high electrical resistance at applied voltages below the clamping voltage and a very low electrical resistance at applied voltages above the clamping voltage. Preferably devices of the invention will continue to exhibit a very high electrical resistance at applied voltages below the clamping voltage and a very low electrical resistance at applied voltages above the clamping voltage after at least 100 pulse waveforms having a sufficient pulse amplitude to cause the device to switch to its low resistance state. More preferably devices of the invention will continue to exhibit a very high electrical resistance at applied voltages below the clamping voltage and a very low electrical resistance at applied voltages above the clamping voltage after at least 500 pulse waveforms having a sufficient pulse amplitude to cause the device to switch to its low resistance state. Most preferably devices of the invention will continue to exhibit a very high electrical resistance at applied voltages below the clamping voltage and a very low electrical resistance at applied voltages above the clamping voltage after at least 1000 pulse waveforms having a sufficient pulse amplitude to cause the device to switch to its low resistance state.

Figure 6:
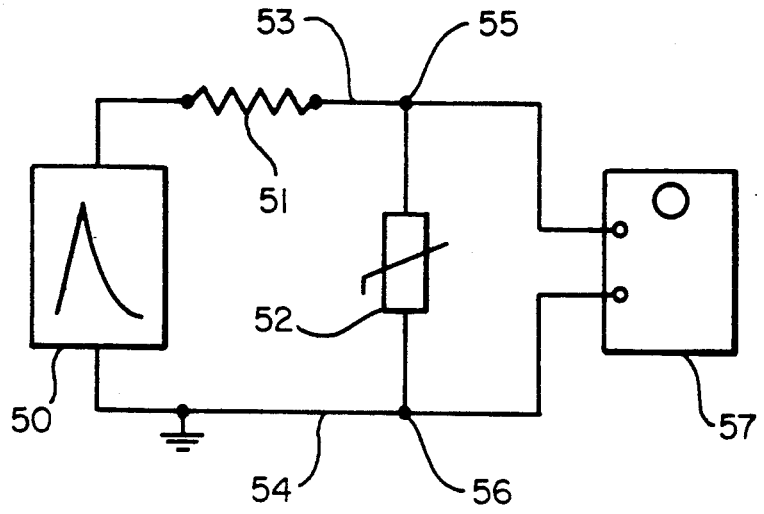
FIG. 6 is a typical test setup for measuring the response to high voltage pulses of devices made from the invention.

FIG. 6 shows a test circuit for measuring the electrical response of a device made with materials of the present invention. A fast rise-time pulse, typically one to five nanosecond rise time, is produced by pulse generator 50. The output impedance 51 of the pulse generator is fifty ohms. The pulse is applied to non-linear device under test 52 which is connected between the high voltage line 53 and the system ground 54. The voltage versus time characteristics of the non-linear device are measured at points 55 and 56 with a high speed storage oscilloscope 57.

EXAMPLE I

The devices shown in FIG. 3 and described above used the following formulation, by weight: fluorosilicone (Dow Corning LS-2840), 71.0 grams; nickel powder (particle size, 44 microns and higher, substantially spherical), 108.0 grams; silicon carbide (particle size, 1 to 5 microns), 14.0 g; and 2,4-dichlorobenzoyl peroxide, 3.0 g. These ingredients were blended together on a two-roll rubber mill and pressed into sheets between thin copper electrodes or transfer molded around a pin within a ferrule to produce the devices shown in FIG. 3. The devices were then heated for 4 hours at 125° C. in an oven to cure, that is crosslink, the polymer and their electrical properties then determined. Table I shows typical electrical properties of the pin and ferrule device made from this material formulation.

TABLE I

| |
|---|
| Threshold Voltage: 275 to 350 volts (the range of 30 devices tested) |
| Clamp Voltage: 100 to 150 volts (also the range of 30 devices tested) |
| Electrical Resistance in off-state (100 volts applied): $>10^9$ ohms |
| Electrical Resistance in on-state: generally less than 4 ohms, depending on transient pulse amplitude |
| Capacitance: 8 picofarads |

Devices produced in this way were subjected to a lightning simulator test. In this test, a model 587 Voltage/current generator (from Velonex, and which meets or exceeds the requirements of ANSI/IEEE C62.41-1989 {formerly IEEE STD 587-1980}, category A and B) was configured to deliver a dual exponential 8/20 microsecond waveform (a pulse having a rise time of 8 microsecons and a width of 20 micro-seconds as described in the ANSI/IEEE document), under short circuit conditions. The output terminals were then connected, through a 50 ohm resistor to the terminals of pin and ferrule devices of the invention. The behavior of the device when a simulated lightning pulse was applied is shown in FIG. 5. It was found that these devices could withstand up to 1000 of such pulses without significant increase in the clamping voltage.

This formulation was employed to construct other device geometries: a disk geometry where the switching material is sandwiched between two metal electrodes with wire leads attached to the electrodes; a discoidal geometry where the switching material is molded between an inner metal ring and an outer metal ring, the rings serving as electrodes; and a tubular geometry where the switching material is molded in the annular region between an outer metal tube (or ferrule) and an inner metal tube, the two tubes serving as electrodes. All these devices were found to have similar performance characteristics.

EXAMPLE II

A second example of the material formulation, by weight, is fluorosilicone (Dow Corning LS-2840), 71.0 g; nickel powder (particle size, 44 microns and greater), 99.5 g; 2,4-dichlorobenzoyl peroxide, 3.0 g. This material was transfer molded pin and ferrule devices and cured as in Example 1. Testing of these devices showed that they functioned very effectively as foldback switching devices. Behaviour in the lightning simulator test was similar to that shown in FIG. 5. However, the shape of the clamped pulse would change as repeated pulses were applied to the device. It was found that after about 20 pulses the clamping voltage increased. Table II shows the electrical characteristics of pin and ferrule devices using this formulation.

TABLE II

| |
|---|
| Threshold Voltage: 350–450 volts |
| Clamping Voltage: 50–100 volts |
| Electrical Resistance in off-state (at 100 volts): $10^9$ ohms |
| Electrical Resistance in on-state: $<10$ ohms (depending on pulse amplitude) |
| Capacitance: 9 picofarads |

EXAMPLE III

A third example of the material formulation, by weight, is fluorosilicone (Dow Corning LS-2840), 71.0 g; Nickel powder (particle size, 10 to 40 microns), 108.0 g; silicon carbide particle size 1 to 5 microns), 14.0 g; 2,4-dichlorobenzoyl peroxide, 3.0 g. This material was transfer molded into pin and ferrule devices and cured as in Example 1. Testing of these devices showed that they functioned very effectively as foldback switching devices with a slightly higher clamping voltage between 150 and 200 volts) than that exhibited by the material of Example 1. Behaviour in the lightning simulator test was similar to that shown in FIG. 5. However, the shape of the clamped pulse would change somewhat as as repeated pulses were applied to the device. It was found that this formulation performed better than that of Example II but not as well as that of Example I.

EXAMPLE IV

This Example describes a test that can be used to determine the performance of devices of the invention or the suitability of materials for use in devices of the invention. FIG. 6 shows a test circuit for measuring the electrical response of a device made with materials of the present invention and which may be used for this test. A fast rise-time pulse, typically about 100 nanosecond rise time, is produced by pulse generator 50. The output impedance 51 of the pulse generator is fifty ohms. The pulse is applied to switching device under test 52 which is connected between the high voltage line 53 and the system ground 54. The voltage versus time characteristics of the switching device are measured at points 55 and 56 with a high speed storage oscilloscope 57. In the test a fast rise time pulse such as one produced by a Schaffner NSG-222 pulser is applied to a device. Devices which exhibit a foldback when the pulse amplitude is 1000 volts are satisfactory for further examination. Formulations not producing foldback characteristics under these conditions are deemed to be unsuitable for presently intended applications. A formulation similar to that of Example II but employing 1 to 5 micron particle size nickel powder does not exhibit foldback behaviour under these conditions and is therefore not suitable for use in this invention.

A wide range of polymer and other matrices or binders, conductive powders, formulations and materials are suitable for use in this invention. Conductive particles which can be blended with a matrix or binder to form the switching material in this invention include metal powders of aluminum, beryllium, nickel, iron, gold, silver, platinum, lead, tin, bronze, brass, copper, bismuth, cobalt, magnesium, molybdenum, palladium, tantalum, tungsten and alloys thereof. Semiconductive particles which can be blended with the matrix or binder and conductive particles to improve the performance of the switching material in this invention include carbides including silicon carbide, titanium carbide, boron carbide, tungsten carbide, and tantalum carbide, powders based on carbon including carbon black and graphite, as well as metal nitrides and metal borides. The insulating matrices or binders can include but are not limited to organic polymers such as polyethylene, polypropylene, natural or synthetic rubbers, urethanes, and epoxies, silicone rubbers, fluoropolymers such as fluorosilicones and polytetrafluoroethylene and its copolymers, and polymer blends and alloys. Other insulating matrices or binders include ceramics, refractory materials, waxes, oils, and glasses. The primary function of the matrix or binder is to establish and maintain the inter-particle spacing of the conducting particles. It is also believed that the nature of the response of the matrix material to dielectric breakdown is an important indicator of its suitability for use in this invention.

Those matrix materials or material formulations that do not undergo the irreversible formation of short circuit paths on dielectric breakdown are suitable for use in this invention.

The matrix or binder, while substantially an insulator, can be tailored as to its resistivity by adding to it or mixing with it various materials to alter its electrical properties. Such materials include powdered varistors, organic semiconductors, coupling agents, and antistatic agents.

A wide range of formulations can be prepared following the above guidelines to provide materials with various inter-particle spacings which give clamping voltages from fifty volts to fifteen thousand volts. The inter-particle spacing is determined by the particle size and volume percent loading. The device thickness and geometry also govern the final clamping voltage.

Figure 7:
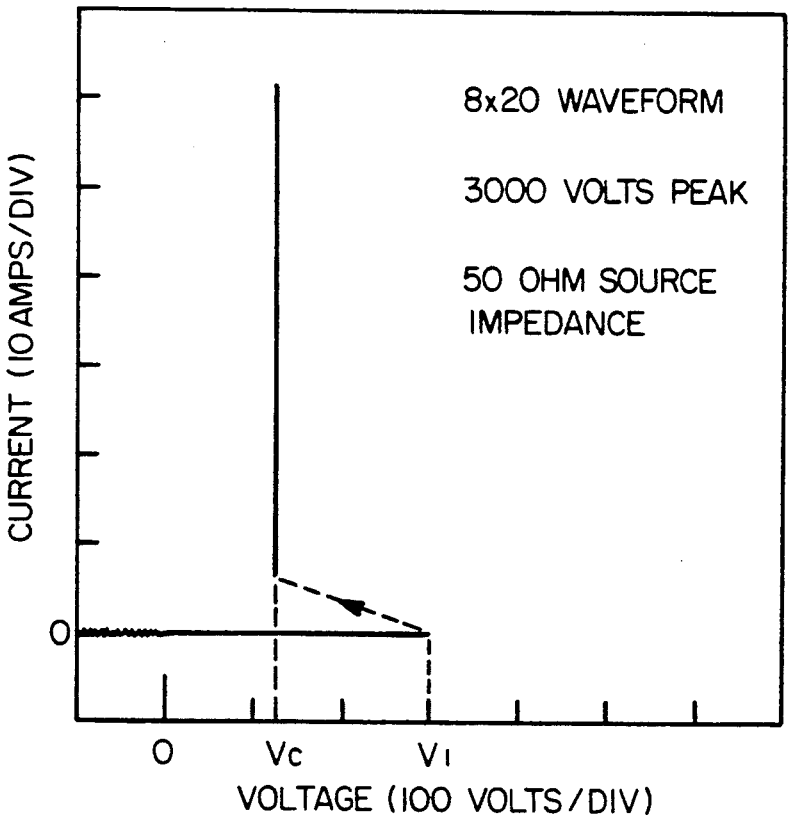
FIG. 7 is a graph of current versus voltage for a device made from the present invention.

The current-voltage characteristics of a device made from the present invention are shown in FIG. 7 over a wide voltage range. This curve is typical of a device made from materials from either Example I or Example II. The foldback switching nature of the material and device is readily apparent from FIG. 7. The voltage level labeled $V_1$ is referred to as the threshold voltage, the voltage $V_c$ is referred to as the clamping voltage. Below the clamping voltage $V_c$, the resistance is constant, or ohmic, and very high, typically at least 10 meg-ohms and often as high as $10^9$ ohms. Above the clamping voltage Vc the resistance is extremely low, for example, less than 10 ohms for devices made from the present invention.

Processes of fabricating the material of this invention include standard polymer processing techniques and equipment. A preferred process utilizes a two roll rubber mill for incorporating the conductive particles into the matrix or binder material. The polymer material is banded on the mill, the crosslinking agent if required is added, and the conductive particles added slowly to the matrix or binder. After complete mixing of the conductive particles into the matrix or binder the blended formulation is sheeted off the mill rolls. Other polymer processing techniques can be utilized including Banbury mixing, extruder mixing and other similar mixing equipment. Material of desired thickness is molded between electrodes under heat and pressure to cure the polymer. Further packaging for environmental protection can be utilized if required.

In the case of a polymer matrix or binder, for example, the material can be molded for applications at virtually all levels of electrical systems, including integrated circuit dies, discrete electronic devices, printed circuit boards, electronic equipment chassis, connectors, cable and interconnect wires, and antennas.

We claim:

1. A foldback switching material comprising:

a) an insulating matrix; and b) conductive particles, which have particle sizes in the range 10 microns to two hundred microns and are spaced at least 1000 Angstroms apart, dispersed in the matrix; which material has a very high electrical resistance at an applied voltage below a clamping voltage and a very low electrical resistance at an applied voltage above the clamping voltage.

2. A material according to claim 1, wherein the distance between conductive particles is at least 5000 Angstroms.

3. A material according to claim 1 wherein the matrix is an electrical insulator.

4. A material according to claim 1 wherein the matrix material is selected from the class of organic polymers such as polyethylene, polypropylene, (polyvinyl chloride), natural or synthetic rubbers, urethanes, epoxies, silicone rubbers, fluoropolymers, and polymer blends and alloys.

5. A material according to claim 1 wherein the matrix material is selected from the class of materials including ceramics, and refractory alloys.

6. A material according to claim 1 wherein the matrix material is a glass.

7. A material according to claim 1 wherein the matrix material includes fumed silicon dioxide, quartz, alumina, aluminum trihydrate, feldspar, silica, barium sulphate, barium titanate, calcium carbonate, woodflour, crystalline silica, talc, mica, or calcium sulphate.

8. A material according to claim 1 wherein the conductive particles comprise at least one of powders of nickel aluminum, beryllium, iron, gold, silver, platinum, lead, tin, bronze, brass, copper, bismuth, cobalt, magnesium, molybdenum, palladium, tantalum, tungsten and alloys thereof.

9. A material according to claim 1 wherein the conductive particles comprise at least one of hollow or solid glass spheres each coated with at least one conductor selected from powders of nickel, aluminum, beryllium, iron, gold, silver, platinum, lead, tin, bronze, brass, copper, bismuth, cobalt, magnesium, molybdenum, palladium, tantalum, tungsten and alloys thereof.

10. A material according to claim 1 wherein the conductive particles have resistivities ranging from about $10^{-1}$ to $10^{-6}$ ohm-centimeters.

11. A material according to claim 1 wherein the percentage, by volume, of conductive particles in the material is greater than about 0.5% and less than about 50%.

12. A material according to claim 1 which also comprises semiconductive particles.

13. A material according to claim 12, wherein the semiconductive particles comprise one or more of carbides including one or more of silicon carbide, titanium carbide, boron carbide, tungsten carbide, and tantalum carbide; powders based on carbon including carbon black and graphite; metal nitrides and metal borides.

14. A material according to claim 12 also comprising hollow or solid glass spheres coated with a semi-conductor comprising at least one of carbides including one or more of silicon carbide, titanium carbide, boron carbide, tungsten carbide and tantalum carbide; one or more of powders based on carbon including carbon black and graphite; metal nitrides and metal borides.

15. A foldback switching device comprising a foldback switching material positioned between electrodes, the material comprising:

a) an insulating matrix; and b) conductive particles, which have particle sizes in the range from 10 microns to 200 microns and are spaced at least 1000 Angstroms apart, dispersed in the matrix;

the material having a very high electrical resistance at applied voltages below a clamping voltage and a very low electrical resistance at applied voltages above the clamping voltage.

16. A foldback switching device according to claim 15 which conducts transient electrical pulses having an amplitude greater than the clamping voltage of the device from one electrode to another by undergoing dielectric breakdown.

17. A device according to claim 15, which, after switching and thereby clamping at least 15 transient electrical pulses having an amplitude greater than the clamping voltage of the device, continues to exhibit a very high electrical resistance at applied voltages below the clamping voltage and a very low electrical resistance at applied voltages above the clamping voltage.

18. A device according to claim 17, which, after switching and thereby clamping at least 100 transient electrical pulses having an amplitude greater than the clamping voltage of the device, continues to exhibit a very high electrical resistance at applied voltages below the clamping voltage and a very low electrical resistance at applied voltages above the clamping voltage.

19. A device according to claim 17, which, after switching and thereby clamping at least 500 transient electrical pulses having an amplitude greater than the clamping voltage of the device, continues to exhibit a very high electrical resistance at applied voltages below the clamping voltage and a very low electrical resistance at applied voltages above the clamping voltage.

20. A device according to claim 17, which, after switching and thereby clamping at least 1000 transient electrical pulses having an amplitude greater than the clamping voltage of the device, continues to exhibit a very high electrical resistance at applied voltages below the clamping voltage and a very low electrical resistance at applied voltages above the clamping voltage.

21. An electrical circuit, which is subject to voltage transients, comprising:

(A) an electrical component which is damaged by application of such a transient thereunto;

(B) a current carrying line;

(C) an earth and (D) a foldback switching device, connected between the current carrying line and earth, which comprises a foldback switching material positioned between electrodes, the material comprising:

a) an insulating matrix; and b) conductive particles, which have particle sizes in the range 10 microns to two hundred microns and are spaced at least 1000 Angstroms apart, dispersed in the matrix; and the material having a very high electrical resistance at applied voltages below a clamping voltage and a very low electrical resistance at applied voltages above the clamping voltage.

* * * * *